US010458057B2

(12) United States Patent
Mazzarella et al.

(10) Patent No.: US 10,458,057 B2
(45) Date of Patent: Oct. 29, 2019

(54) CLOTHES DRYER WITH A FOAM SEAL

(71) Applicant: WHIRLPOOL CORPORATION, Benton Harbor, MI (US)

(72) Inventors: Antonio Mazzarella, Fabriano (IT); Davide Parachini, Comerio (IT); Gianbattista Pirola, Dalmine (IT); George F. Seiffert, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 162 days.

(21) Appl. No.: 15/634,190

(22) Filed: Jun. 27, 2017

(65) Prior Publication Data

US 2018/0371678 A1 Dec. 27, 2018

(51) Int. Cl.
*D06F 58/06* (2006.01)
*D06F 58/04* (2006.01)

(52) U.S. Cl.
CPC ..... *D06F 58/06* (2013.01); *D06F 58/04* (2013.01)

(58) Field of Classification Search
CPC ..... D06F 58/06; D06F 58/04
USPC ..... 34/601
See application file for complete search history.

(56) References Cited

U.S. PATENT DOCUMENTS 3,323,224 A * 6/1967 Lough ..... D06F 58/22 34/82
3,637,224 A * 1/1972 Triplett ..... D06F 58/04 277/399
4,430,809 A * 2/1984 Jackson ..... D06F 58/06 34/601
4,621,438 A * 11/1986 Lanciaux ..... D06F 58/04 34/242
4,669,200 A * 6/1987 Carr ..... D06F 58/04 277/402
5,363,569 A * 11/1994 Kadakia ..... D06F 58/04 34/242
5,548,908 A * 8/1996 Torborg ..... D06F 58/06 34/601
5,979,195 A * 11/1999 Bestell ..... D06F 37/266 68/139
7,007,955 B2 * 3/2006 Cross ..... D06F 58/04 277/652
7,836,607 B2 * 11/2010 Kim ..... D06F 58/04 165/158
7,921,578 B2 * 4/2011 McAllister ..... D06F 35/00 134/10

(Continued)

FOREIGN PATENT DOCUMENTS

DE 102014202237 A1 8/2015
EP 2423375 A1 2/2012
EP 2829652 A1 1/2015

OTHER PUBLICATIONS

European Search Report for Counterpart EP18165362.7, dated Oct. 25, 2018.

*Primary Examiner* — Stephen M Gravini
(74) *Attorney, Agent, or Firm* — McGarry Bair PC

(57) ABSTRACT

A clothes dryer with a first bulkhead having an access opening and a first edge defining a front opening confronting the access opening. The clothes dryer has a composite seal located between the first bulkhead and the first edge which has a foam layer comprising memory foam and a low-friction layer having a coefficient of kinetic friction less than 0.3, with the low friction layer confronting the first edge.

20 Claims, 4 Drawing Sheets

(56) References Cited

U.S. PATENT DOCUMENTS

| | | | | |
|---|---|---|---|---|
| 8,028,439 | B2 * | 10/2011 | Prajescu | F16J 15/061 165/89 |
| 8,127,464 | B2 * | 3/2012 | Schone | D06F 39/14 312/228 |
| 9,580,856 | B1 * | 2/2017 | Schurr | D06F 58/04 |
| 9,758,919 | B2 * | 9/2017 | Hong | D06F 5/08 |
| 9,970,705 | B2 * | 5/2018 | Lowe | F26B 25/008 |
| 10,066,336 | B2 * | 9/2018 | Schurr | D06F 58/04 |
| 2007/0044342 | A1 | 3/2007 | Burns et al. | |
| 2008/0157037 | A1 | 7/2008 | Stidham et al. | |
| 2013/0174435 | A1 | 7/2013 | Rockwell et al. | |
| 2014/0327212 | A1 * | 11/2014 | Lowe | F16J 15/16 277/345 |
| 2018/0274160 | A1 * | 9/2018 | Lowe | D06F 37/263 |
| 2018/0371678 | A1 * | 12/2018 | Mazzarella | D06F 58/04 |

* cited by examiner

CLOTHES DRYER WITH A FOAM SEAL

BACKGROUND OF THE INVENTION

Automatic clothes dryers work by passing dry heated air around and through laundry to evaporate and carry away moisture from the laundry, typically by venting it through a duct to an outdoor environment. A clothes dryer has a cabinet that encloses the other elements of the clothes dryer, including a stationary housing or bulkhead, and a cylindrical drum rotationally supported within the housing into which laundry is placed. The drum rotates on its central axis, tumbling the laundry within the drum. Hot air is forced through the rotating drum over and through the laundry to evaporate and carry away moisture the moisture in the laundry. A seal is provided between the stationary housing and the rotating drum to retard or prevent air flow leakage from the drum. The seal between the housing and the drum commonly takes the form of an annular ring permanently affixed to the bulkhead and placed to bear against an edge of the drum as it rotates. The foam used in the seals is generally of a type that provides high compression against the edge of the drum as it rotates to provide a good seal.

SUMMARY

One exemplary embodiment is a clothes dryer having a first bulkhead with an access opening and a rotating drum having a first edge defining a first drum opening. A composite seal is located between the first bulkhead and the first edge and has a foam layer comprising memory foam and a low-friction layer having a coefficient of kinetic friction less than 0.3, with the low friction layer confronting the first edge.

Another exemplary embodiment is a clothes dryer with a first bulkhead having an access opening and a rear bulkhead spaced from the first bulkhead. An annular channel is located in one of the front or rear bulkheads. A rotating cylindrical wall having at least one edge is received within the annular channel. A composite seal is located within the annular channel and comprises a foam layer and a low-friction layer abutting the annular channel. The foam layer is a low compression memory foam.

It is to be understood that both the foregoing general description and the following detailed description are exemplary and explanatory and are intended to provide further explanation of the invention as claimed.

DESCRIPTION OF EMBODIMENTS OF THE INVENTION

Figure 1:
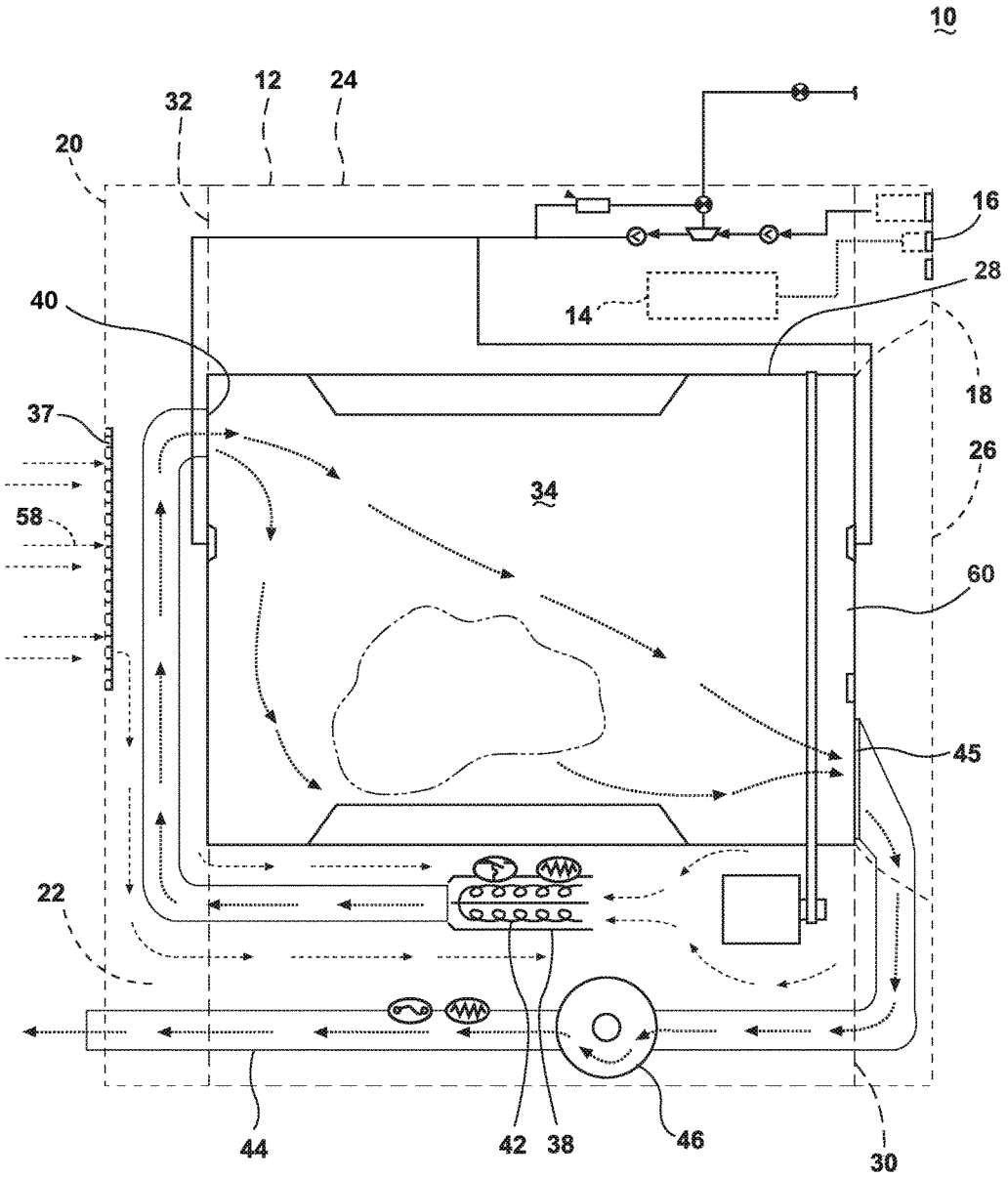
FIG. 1 is a schematic view of an exemplary clothes dryer.

Turning now to the figures, FIG. 1 shows a detailed schematic view of an exemplary embodiment of a clothes dryer 10. The clothes dryer 10 described herein shares many features of a traditional automatic clothes dryer, which will not be described in detail except as necessary for a complete understanding of the invention. While embodiments of the invention are described in the context of a clothes dryer 10, the embodiments of the invention can be used in any context that includes opposed elements in relative motion wherein one slides against another effectively forming a barrier to a gas under pressure.

As illustrated in FIG. 1, the clothes dryer 10 can include a cabinet 12 in which is provided a controller 14 that can receive input from a user through a user interface 16 for selecting a cycle of operation and controlling the operation of the clothes dryer 10 to implement the selected cycle of operation. The cabinet 12 can be defined by a front wall 18, a rear wall 20, and a pair of side walls 22 supporting a top wall 24. A door 26 can be hingedly mounted to the front wall 18 and can be selectively movable between opened and closed positions to close an opening in the front wall 18, which provides access opening 60 to the interior of the cabinet 12.

A rotatable drum 28 can be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 cannot be removed merely by draining.

An air system can also be provided with the clothes dryer 10. The air system supplies air to the treating chamber 34 and exhausts air from the treating chamber 34. The supplied air can be heated or not. The air system can have an air supply portion that can form, in part, a supply conduit 38, which has one end open to ambient air via a rear vent 37 and another end fluidly coupled to an inlet grill 40, which can be in fluid communication with the treating chamber 34. A heating element 42 can lie within the supply conduit 38 and can be operably coupled to and controlled by the controller 14. If the heating element 42 is turned on, the supplied air will be heated prior to entering the drum 28.

The air system can further include an air exhaust portion that can be formed in part by an exhaust conduit 44. An exhaust outlet 45 can be provided as the inlet from the treating chamber 34 to the exhaust conduit 44. A blower 46 can be fluidly coupled to the exhaust conduit 44. The blower 46 can be operably coupled to and controlled by the controller 14. Operation of the blower 46 draws air into the treating chamber 34 as well as exhausts air from the treating chamber 34 through the exhaust conduit 44. The exhaust conduit 44 can be fluidly coupled with a household exhaust duct (not shown) for exhausting the air from the treating chamber 34 to the outside of the clothes dryer 10.

In general, the controller 14 will effect a cycle of operation to effect a treating of the laundry in the treating chamber 34, which can include drying. The controller 14 can actuate the blower 46 to draw an inlet air flow 58 into the supply conduit 38 through the rear vent 37 when air flow is needed for a selected treating cycle. The controller 14 can activate the heating element 42 to heat the inlet air flow 58 as it passes over the heating element 42, with the heated air being supplied to the treating chamber 34. The heated air can be in contact with a laundry load 36 as it passes through the treating chamber 34 on its way to the exhaust conduit 44 to effect a moisture removal of the laundry. The heated air can exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry.

Figure 2:
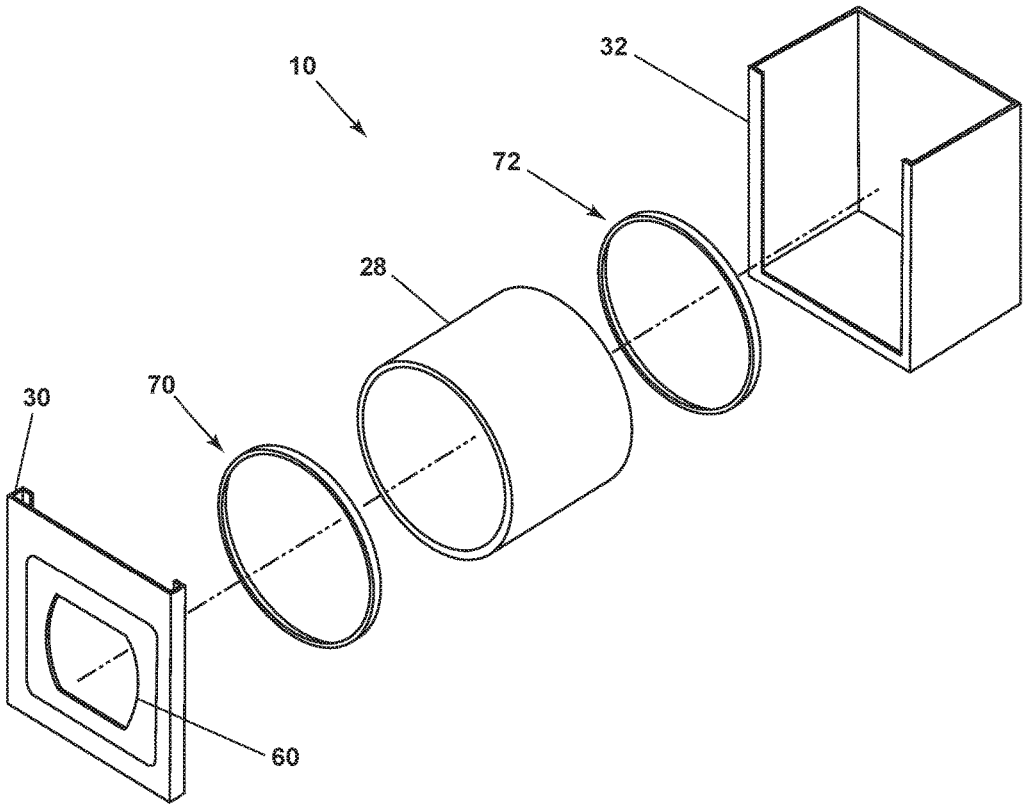
FIG. 2 is a partial exploded view of the clothes dryer according to FIG. 1.

FIG. 2 is a partial exploded view of the clothes dryer showing seals 70, 72 between the drum 28 and bulkheads 30, 32, respectively, of cabinet 12. For simplicity, cabinet side walls 22 and top wall 24 are not shown. Similar to FIG. 1, this partial exploded embodiment shows first and rear bulkheads 30, 32, seals 70, 72 and drum 28. The first bulkhead 30 of the cabinet 12 includes an access opening 60 for loading articles of laundry or other textiles into the drum 28. The first bulkhead 30 surrounds access opening 60 in which front seal 70 is fixedly attached thereto. The front seal 70 confronts the front of the drum 28 as the drum 28 rotates in operation. Similar to the front seal 70, rear seal 72 can be also attached to rear bulkhead 32. Rear seal 72 also confronts the rear of the drum 28 as the drum 28 rotates. Together, the front and rear seals, 70, 72 provided between the first and rear bulkheads 30, 32 of cabinet 12 and the rotating drum 28, prevent air leakage from the drum 28 of the clothes dryer 10.

Figure 3:
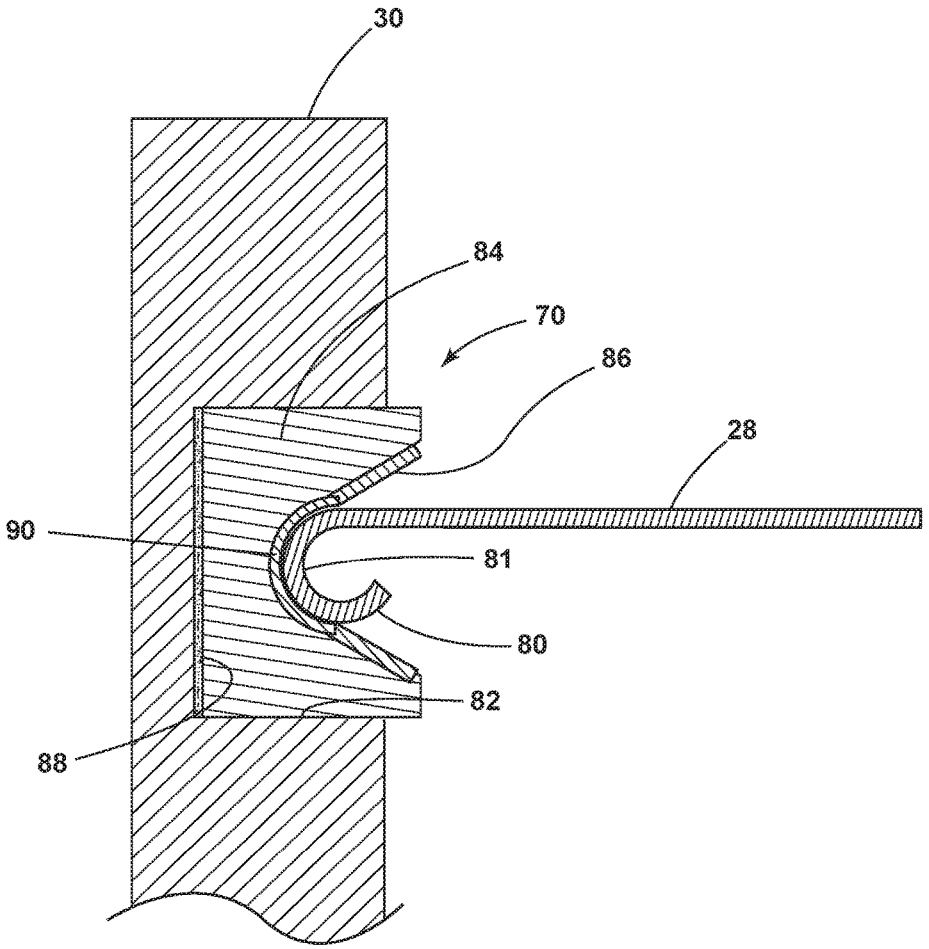
FIG. 3 is a cross-sectional view of a seal mounted in a bulkhead of the clothes dryer of FIG. 1.

FIG. 3 is a cross-sectional view of an exemplary embodiment of seal 70 positioned between a first edge 80 of the drum 28 and the first bulkhead 30. The seal 70 can be in the form of an annular ring located in annular channel 82 between the first edge 80 of the drum 28 and the first bulkhead 30. The first edge 80 of the drum 28 can comprise a curl 81 that extends into the channel 82 and contacts seal 70. Channel 82 circumscribes the access opening 60. Although only a front seal 70 and first bulkhead 30 are shown, a similar arrangement can also or alternatively be included where the rear seal 72 meets the rear bulkhead 32.

The seal 70 can comprise a foam layer 84 and low-friction layer 86 and can be secured within annular channel 82 of bulkhead 30. The foam layer 84 confronts the first bulkhead 30 and can be secured to the first bulkhead 30 with a layer of adhesive 88. The foam layer 84 is formed of a memory foam having a density in the 37-55 kg/m^3 range, with the specific implementation being about 40 kg/m^3. The memory foam is also low compression resistance and has a compression resistance in the 1-4 kilopascal (kPa) range, with the specific implementation of a compression resistance of about 2 kPa. The memory foam is a closed cell foam. The low-friction layer 86 is felt or other low-friction material bonded to the foam layer 84 and confronts and contacts the curl 81 of first edge 80 of drum 28. The low-friction material 84 has a kinetic friction coefficient in the 0.1 to 0.3 range, with a specific implementation of kinetic friction coefficient of about 0.2.

In an exemplary embodiment, the foam layer 84 is thicker than the low-friction layer 86 and the two layers are bonded or otherwise secured together. The low-friction layer 86 can be heat bonded to the foam layer 84. Alternatively or additionally, the low-friction layer 86 can be bonded to the foam layer using an adhesive or other securing mechanism. The foam layer 84 can be temperature resistant, preferably at least up to a temperature of 90 degrees C. or thereabouts.

It is noted that using a memory foam for the foam layer 84 with high density and low compression containing a channel 90 in which the first edge 80 of a rotating drum 28 slides, is more energy efficient in operation than other types of foam seals that do not comprise such a channel. This is because the spring force from the compression of the foam layer 84 in the channel does not push back on the drum 28 with as much force as other types of seals, yet it still provides an adequate seal.

Figure 4:
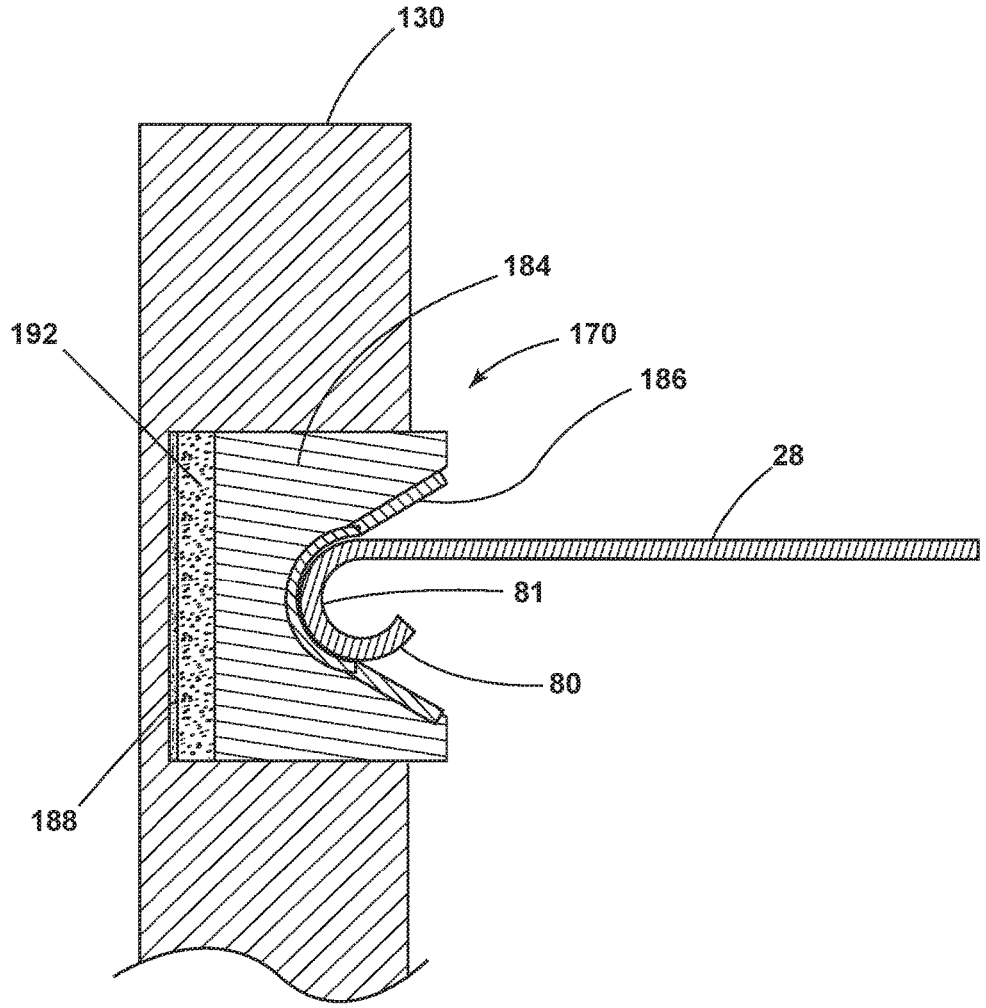
FIG. 4 is a cross-sectional view of an alternate embodiment a seal mounted in a bulkhead of the clothes dryer of FIG. 1.

FIG. 4 is a cross-sectional view of another embodiment of seal 170 that has similarities with the seal 70 of FIG. 3. Therefore, elements of the seal 170 that are similar to the seal 70 are labeled with similar part numbers using the prefix 100. The seal 170 is positioned between a first edge 80 of the drum 28 and the first bulkhead 130. Although only a front seal 170 and first bulkhead 130 are shown, a similar arrangement can also or alternatively be included where the rear seal meets the rear bulkhead.

The seal 70 can comprise a low-friction layer 186, a first foam layer 184, and a second foam layer 192, and can be secured within annular channel 182 of bulkhead 130. In this embodiment, the second foam layer 192 confronts the first bulkhead 130 and can be secured to the first bulkhead 130 with a layer of adhesive 188. The second foam layer 192 is formed of foam having a density in the 25-35 kg/m^3 range, with the specific implementation being about 30 kg/m^3. The second foam layer 192 is a closed cell foam. The second foam layer 192 can be heat bonded or otherwise secured to the first foam layer 184. The low-friction layer 186 is felt or other low-friction material and can be bonded to the first foam layer 184 and confronts and contacts the curl 81 of first edge 80 of drum 28.

Similar to the embodiment of FIG. 3, the first foam layer 184 is formed of a memory foam having a density in the 37-55 kg/m^3 range, with the specific implementation being about 40 kg/m^3. The memory foam is also low compression resistance and has a compression resistance in the 1-4 kilopascal (kPa) range, with the specific implementation of a compression resistance of about 2 kPa. The low-friction material 184 has a kinetic friction coefficient in the 0.1 to 0.3 range, with a specific implementation of kinetic friction coefficient of about 0.2.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A clothes dryer comprising:

a cabinet defining an interior and having a first bulkhead at least partially defining an access opening to the interior;

a rotating drum having a first edge defining a first drum opening; and a composite seal located between the first bulkhead and the first edge, the composite seal receiving the first edge and having a foam layer comprising memory foam and confronting the first bulkhead and a low-friction layer having a coefficient of kinetic friction less than 0.3, with the low-friction layer confronting and receiving the first edge.

2. The clothes dryer of claim 1 wherein the memory foam has a density in a 37-55 kg/m^3 range.

3. The clothes dryer of claim 2 wherein the memory foam has a density of 40 kg/m^3.

4. The clothes dryer of claim 2 wherein the memory foam has a compression resistance in a 1-4 kilopascal (kPa) range.

5. The clothes dryer of claim 4 wherein the memory foam has a compression resistance of 2 kPa.

6. The clothes dryer of claim 1 wherein the foam layer confronts the first bulkhead.

7. The clothes dryer of claim 6 wherein the foam layer is adhered to the first bulkhead.

8. The clothes dryer of claim 7 wherein the memory foam is a closed cell foam.

9. The clothes dryer of claim 4 wherein the foam layer is thicker than the low-friction layer.

10. The clothes dryer of claim 1 wherein the first bulkhead comprises a channel and the composite seal is located within the channel.

11. The clothes dryer of claim 10 wherein the channel circumscribes the access opening.

12. The clothes dryer of claim 11 wherein the first edge comprises a curl which extends into the channel.

13. The clothes dryer of claim 1 wherein the low-friction layer is heat sealed to the foam layer.

14. The clothes dryer of claim 1 wherein the foam layer is temperature resistant up to approximately 90 degrees C.

15. The clothes dryer of claim 1 further comprising a second foam layer having a first side bonded to the memory foam layer and a second side adhered to the first bulkhead.

16. A clothes dryer comprising:

a cabinet defining an interior and having a first bulkhead at least partially defining an access opening to the interior;

a rear bulkhead spaced from the first bulkhead;

an annular channel provided within at least one of the first and rear bulkheads;

a rotating cylindrical wall having at least one edge received within the annular channel; and a composite seal located within annular channel and comprising a foam layer and a low-friction layer, the foam layer confronting the annular channel and the low-friction layer confronting the edge, wherein the foam layer is a low compression resistance memory foam.

17. The clothes dryer of claim 16 wherein the foam layer is adhered to the first bulkhead.

18. The clothes dryer of claim 17 wherein the memory foam has a density in a 37-55 kg/m^3 range and a compression resistance in a 1-4 kilopascal (kPa) range.

19. The clothes dryer of claim 18 wherein the memory foam is a closed cell foam.

20. The clothes dryer of claim 16 wherein the foam layer is temperature resistant up to approximately 90 degrees C.

* * * * *